US008534103B2

(12) United States Patent
Brooks

(10) Patent No.: US 8,534,103 B2
(45) Date of Patent: Sep. 17, 2013

(54) METHOD AND APPARATUS FOR SECURING DOOR MECHANISMS

(76) Inventor: Robert C. Brooks, Hallsville, TX (US)

( * ) Notice: Subject to any disclaimer, the term of this patent is extended or adjusted under 35 U.S.C. 154(b) by 0 days.

(21) Appl. No.: 13/310,474

(22) Filed: Dec. 2, 2011

(65) Prior Publication Data

US 2013/0139563 A1 Jun. 6, 2013

(51) Int. Cl.
*E05B 17/18* (2006.01)

(52) U.S. Cl.
USPC ..... 70/455; 70/54; 70/56; 70/159; 70/417; 70/423; 292/346

(58) Field of Classification Search
USPC ..... 70/54–56, DIG. 56, 158–160, 232, 70/416, 417, 423, 424, 455; 292/346
See application file for complete search history.

(56) References Cited

U.S. PATENT DOCUMENTS 1,328,109 A * 1/1920 Whitlock ..... 70/237
3,096,409 A * 7/1963 Hubbell et al. ..... 200/43.22
3,563,069 A * 2/1971 Ferrer ..... 70/129
3,660,996 A * 5/1972 Syvertson ..... 70/209
3,673,605 A * 6/1972 Allenbaugh ..... 292/346
3,888,096 A * 6/1975 Huss ..... 70/209
3,934,910 A * 1/1976 Radke ..... 292/346
4,033,156 A * 7/1977 Cottingham ..... 70/56
4,044,579 A * 8/1977 Le Bel ..... 70/416
4,064,721 A * 12/1977 Morgan ..... 70/416
4,350,032 A * 9/1982 Kochackis ..... 70/427
4,673,204 A * 6/1987 Allenbaugh ..... 292/346
4,869,087 A * 9/1989 Day ..... 70/417
4,885,921 A * 12/1989 Sharav ..... 70/159
5,068,765 A * 11/1991 Nimpoeno ..... 361/814
5,154,461 A * 10/1992 Prescott et al. ..... 292/346
5,555,752 A * 9/1996 Fitzpatrick ..... 70/159
6,324,879 B1 12/2001 Kennedy
6,658,906 B1 12/2003 Wright
D618,084 S 6/2010 Karabatsos
2009/0289464 A1* 11/2009 Pawson ..... 292/346
2010/0269431 A1* 10/2010 Young ..... 52/204.1

* cited by examiner

*Primary Examiner* — Suzanne Barrett

(57) ABSTRACT

Apparatus and methods for securing a door having one or more door mechanisms via a cover and base. The cover protects the door mechanisms and includes an enclosure fitting over the at least one of the door mechanisms, a first securing member comprising a slot through which a second securing member passes, and a first joint member. A base connects the cover to the door. The base includes one or more second holes extending through which are one or more fastening mechanisms of the door mechanisms protected by the cover, and a second joint member. A releasable joint aligning the cover with respect to the base, is formed by the first joint member of the cover and the second joint member of the base.

16 Claims, 4 Drawing Sheets

METHOD AND APPARATUS FOR SECURING DOOR MECHANISMS

BACKGROUND

This application relates to a protective cover for a locking or closing device.

A door is a movable structure, typically on hinges, that is used to open and close an entrance to a room or dwelling. Doors at the entrance of a dwelling typically have a doorknob and a deadbolt lock. The doorknob and the deadbolt operate to prevent the door from moving or being opened. The doorknob and the deadbolt can be manipulated from both inside of the dwelling and outside of the dwelling by turning the knob or using a key in conjunction with a key mechanism of the deadbolt.

BRIEF DESCRIPTION OF THE FIGURES

Like reference numbers and designations in the various drawings indicate like elements.

DETAILED DESCRIPTION

Figure 1:
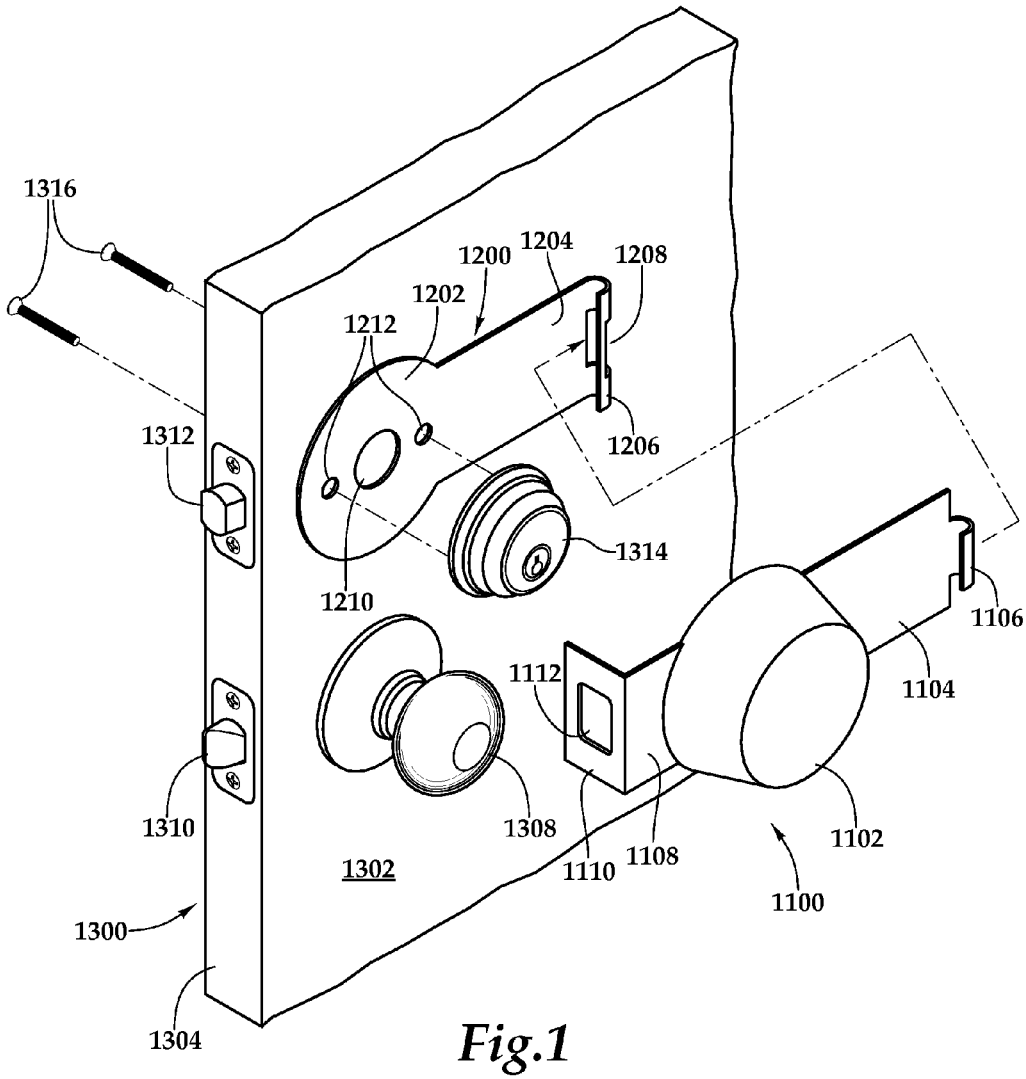
FIG. 1 is a graphical projection of an embodiment that accords with the disclosure.

One or more specific embodiments of the present disclosure will be described below. In an effort to provide a concise description of these embodiments, all features of an actual implementation may not be described in the specification. It should be appreciated that in the development of any such actual implementation, numerous implementation-specific decisions must be made to achieve specific goals, such as compliance-related or business-related goals, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments of the present invention, the articles "a," "an," "the," and "said" are intended to mean that there are one or more of the elements. The terms "comprising," "including," and "having" are intended to be inclusive and mean that there may be additional elements other than the listed elements.

Under certain circumstances, it is desirable to be within a dwelling and prevent others from utilizing various door mechanisms of a door to open a door to the dwelling and gain entry into the dwelling. As an example, the college roommate may wish to use a dormitory room for private activities and prevent his or her roommate from entering the dormitory room. Alternatively, an owner of an apartment may wish to prevent a tenant from entering the apartment, such as when the tenant fails to pay rent. Furthermore, most apparatus for preventing a door from opening are themselves susceptible to being picked or tampered with.

Embodiments of methods and apparatus that accord with the disclosure can prevent access to the doorknob and deadbolt lock, preventing unauthorized entry from lock picking or from use of an unauthorized key. Embodiments can also prevent breaking the doorknob or deadbolt to gain access through the door. Optional embodiments can also make "jimmying" a lock with a credit card or other device much more difficult.

Embodiments in accordance with the disclosure have a base and a cover, which combine and are designed to provide several features and benefits. Embodiments are simple in design having no moving pieces, no parts to wear out, with heavy duty construction that will not be susceptible to easy breakage or damage. The base lays flat with the door, which minimizes the likelihood of prying up. The cover encloses the doorknob, lock, or both and prevents side movement in the event of prying. In optional embodiments, the cover wraps around the side of the door further securing the device from being pried off or pulled out of the door. The part of a doorknob or deadbolt that is outside the door is fastened or screwed to the part of the doorknob or deadbolt that is on the inside of the door; screwing these two parts together compresses the base between the door frame and the outside part of the doorknob or deadbolt to provide extra strength and protection to the base against prying. The shape of the cover minimizes the ability to achieve maximum grip or torque. The base and cover can be made from any suitable material that provides desired strength and protection, including: metals such as aluminum, iron, and steel; high-strength plastics; carbon fiber; any combination thereof, and the like. Regular plastics and wood may also be used to construct the base and cover, when absolute security is less of a concern.

Embodiments are inexpensive to manufacturer and are easy to install only requiring a screwdriver and taking a few minutes to install or remove. Installation requires no drilling or damage to doors and may be used where no permanent attachments are allowed, such as with apartments or dormitories, and no residual damage will need to be repaired if removed. Embodiments in accordance with the disclosure secure the doorknob and deadbolt from tampering, therein protecting against doorknob or lock from damage, protecting against lock picking, protecting against entry by someone with an unauthorized key, and an inhibiting jimmying the door mechanisms. The heavy duty construction and lack of access to door mechanisms enhances the security of the occupants in the dwelling and deters criminals from attempting to enter. Any attempt to remove will create enough noise to give the occupant time call for help.

FIG. 1 is a graphical projection of an embodiment in accordance with the disclosure. FIG. 1 depicts a cover 1100, a base 1200, and a door 1300 that has both a deadbolt 1314 and a doorknob 1308. In this embodiment, the base 1200 and the cover 1300, protect, and secure the deadbolt 1314, but not the doorknob 1308. The deadbolt 1314 operates a bolt 1312, and the doorknob 1308 operates a latch 1310.

The cover 1100 includes an enclosure 1102, a first cover member 1108, and a second cover member 1104. When placed over the deadbolt 1314, the cover 1100 and the enclosure 1102 prevent any tampering or picking and greatly inhibits any prying, jimmying, or damaging of the deadbolt 1314. The enclosure 1102 prevents any access to the key mechanism of the deadbolt 1314 that is secured to the door 1300. The enclosure 1102 may have a substantially similar footprint or profile to that of a first base member 1202 of the base 1200. As depicted in FIG. 1, the enclosure 1102 is in the shape of a cylinder or cone, but maybe in any suitable shape, as desired. The enclosure 1102 prevents any contact from being made with the door mechanism within.

The first cover member 1108 extends from the enclosure 1102 and connects the enclosure 1102 to a first securing member 1110, which also includes a slot 1112. As depicted in FIG. 1, the first cover member 1108 allows the cover 1100 to fit onto two orthogonal faces (1302 and 1304) of the door 1300. As depicted in FIG. 1, the first cover member 1108 may lay substantially flat on or just over the door 1300, but alternative embodiments may have an analogous member of the base 1200 upon or over which the first cover member 1108 lays. Alternative embodiments may have at least one gasket (not shown) between any one or combination of the base 1200, the cover 1100, and the door 1300 made out of any suitable material including rubber, plastic, any combination thereof, and the like. Such a gasket would provide increased protection to the surface and finish of the door 1300 from the base 1200 and from the cover 1100.

The first securing member 1110 includes a slot 1112 through which passes bolt 1312 of the deadbolt 1314. As depicted in the FIG. 1, the first securing member 1110 includes a 90 degree bend to wrap around a first face 1302 and a second face 1304 of the door 1300. When the apparatus is in place and the bolt 1312 of the deadbolt 1314 is engaged and passes through the slot 1112, the bolt 1312 and the securing member 1110 operate to prevent the cover 1100 from being removed or pried from the door 1300.

The second cover member 1104 extends from the enclosure 1102 and connects the enclosure 1102 to a first joint member 1106. The second cover member 1104 lays flat on or just over a second base member 1204 of the base 1200. As depicted in FIG. 1, the second cover member 1104 and the second base member 1204 may have substantially similar profiles. In alternative embodiments, the second cover member 1104 and the second base member 1204 may have different profiles.

The first joint member 1106 is curved around and up with respect to the second cover member 1104. The first joint member 1106 comprises a tab that fits through the slot 1208 of the second joint member 1206 of the base 1200. The first joint member 1106 and the second joint member 1206 combine to form a releasable joint. The releasable joint can align the cover 1100 with respect to the base 1200. Optional embodiments may have the tab of first joint member 1106 be wide enough such that when it is mated within the slot 1208, the releasable joint acts as a hinge that aligns the cover 1100 to the base 1200, supports the weight of the cover 1100, and allows for angular movement of the cover 1100 with respect to the base 1200. While depicted with a curved slot and tab configuration forming a hinge, the releasable joint can be any suitable shape or type of joint. As an example, the releasable joint could be formed from a hasp and loop with the cover having a hasp or slot that fits onto a loop of the base.

The base 1200 includes a first base member 1202 and a second base member 1204. The base 1200 connects the cover 1100 to the door 1300 and sits between the door 1300 and at least one of the door mechanisms protected by the enclosure 1102.

The first base member 1202 includes a first hole 1210 and one or more second holes 1212. The first base member 1202 has a profile that is similar to the footprint of the enclosure 1102.

The first hole 1210 allows an operating mechanism within a door mechanism to pass through the base 1200 and into the door 1300. As depicted in FIG. 1, the key mechanism of deadbolt 1314 passes through the first hole 1210 into the door 1300 so that the bolt 1312 may be operated by the key mechanism of the deadbolt 1314.

The second holes 1212 allow the fasteners of the door mechanism to pass through the base 1200 and into the door 1300. As depicted in FIG. 1, one or more screws 1316 pass through the door 1300, through the second holes 1212, and into the top of the deadbolt 1314. As such, the fasteners 1316 of the door mechanism are used to secure the base 1200 to the door 1300 and the fasteners 1316 are also used to secure the deadbolt 1314 that is protected by the cover 1100 to the door 1300. While depicted as circular, any shape or profile of the second holes may be used.

The second base member 1204 extends from the first base member 1202 and connects the base 1200 to a second joint member 1206. The second base member 1204 lays flat on the face 1302 of the door 1300. As depicted in FIG. 1, the second base member 1204 and the second cover member 1104 may have substantially similar profiles. In alternative embodiments, the second base member 1204 and the second cover member 1104 may have different profiles.

The second joint member 1206 is curved around and up with respect to the second cover member 1204. The second joint member 1206 comprises a slot 1208 through which fits the tab of the first joint member 1106 of the cover 1100. The second joint member 1206 and the first joint member 1106 combine to form a releasable joint, as discussed above.

Figure 2:
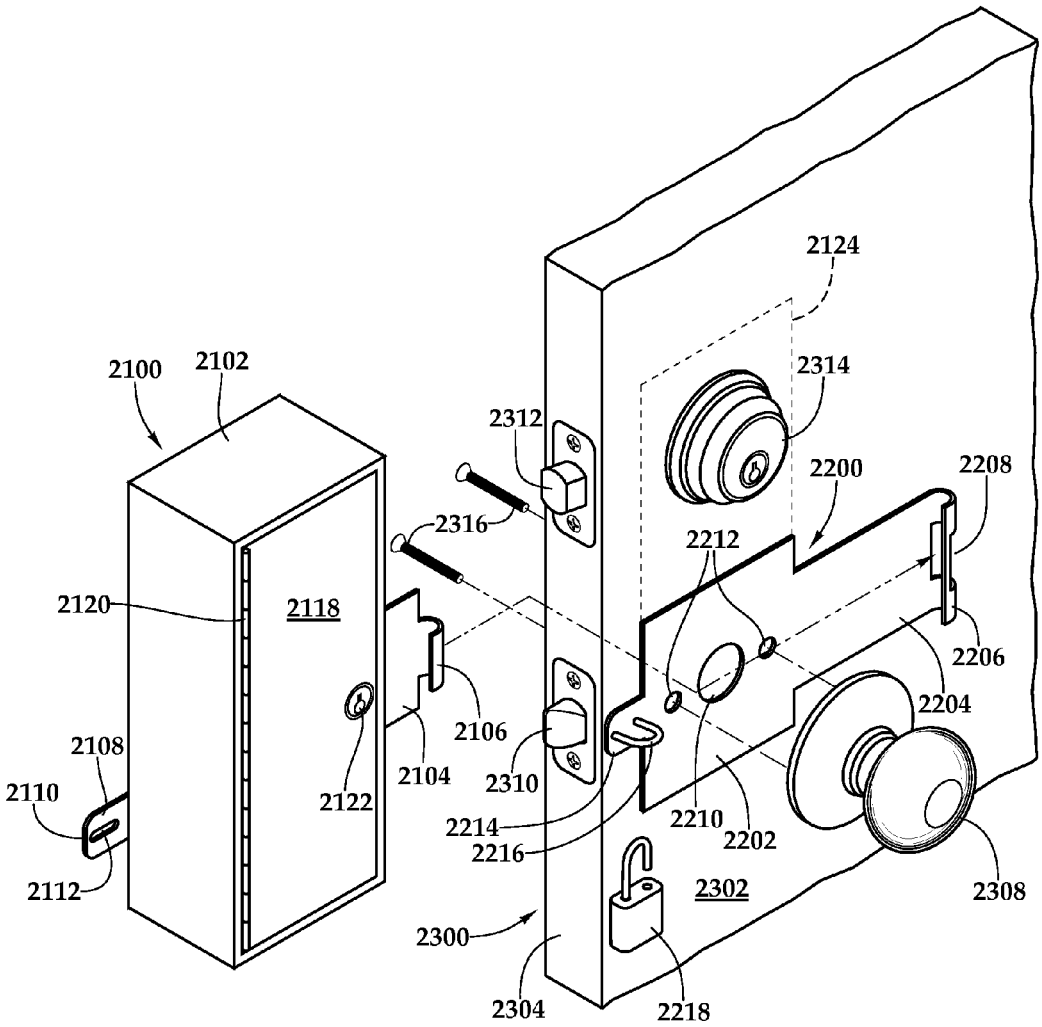
FIG. 2 is a graphical projection of an embodiment that accords with the disclosure.

FIG. 2 is a graphical projection of an embodiment in accordance with the disclosure. FIG. 2 depicts a cover 2100, a base 2200, and a door 2300 that has both a deadbolt 2314 and a doorknob 2308. In this embodiment, the cover protects and secures both the deadbolt 2314 and the doorknob 2308 with the base being secured via the doorknob 2308. The deadbolt 2314 operates a bolt 2312, and the doorknob 2308 operates a latch 2310.

The cover 2100 includes an enclosure 2102, a first cover member 2108, and a second cover member 2104. When placed over the deadbolt 2314 and doorknob 2308, the cover 2100 and the enclosure 2102 prevent any tampering or picking and greatly inhibits any prying, jimmying, or damaging of the deadbolt 2314 and doorknob 2308. The enclosure 2102 prevents unauthorized access to the key mechanism of the deadbolt 2314 and the doorknob 2308 that are secured to the door 2300. The enclosure 2102 may have a substantially similar footprint or profile to that of a first base member 2202 of the base 2200. As depicted in FIG. 2, the enclosure 2102 is in the shape of a cube-like structure or cuboid, but maybe in any suitable shape, as desired. The enclosure 2102 prevents any contact from being made with the door mechanism within.

The enclosure 2102 also includes a door 2118, hinge 2120, and locking mechanism 2122. The door 2118 allows authorized access to the door mechanisms protected by the cover 2100. This is useful where external access to the dwelling is still desired, such as in the landlord tenant example, as described above. As another example, residents of a dormitory may accidentally get locked outside of their room with the cover in place. In such a case, the resident can get a key to the cover from the dormitory's front office to regain access to the deadbolt and doorknob.

The first cover member 2108 extends from the enclosure 2102 and connects the enclosure 2102 to a first securing member 2110, which also includes a hasp or slot 2112. As depicted in FIG. 2, the cover 2100 fits onto a single face 2302 of the door 2300. The first cover member 2108 may lay substantially flat on or just over the door 2300, but alternative embodiments may have an analogous member of the base 2200 upon or over which the first cover member 2108 lays. Alternative embodiments may have at least one gasket (not shown) between any one or combination of the base 2200, the cover 2100, and the door 2300 made out of any suitable material including rubber, plastic, any combination thereof, and the like. Such a gasket would provide increased protection to the surface and finish of the door 2300 from the base 2200 and from the cover 2100.

Additional or alternative embodiments may have extension 2108 further extend (not shown) and wrap around the side of the door much like as shown in FIG. 1. Such an embodiment would then have two slots used for securing the cover to the base, with one slot as a part of the hasp and loop and the other slot for the bolt that slides in and out of the door. This would provide additional security and protection, and would also further prevent the cover from being removed.

The first securing member 2110 includes a slot 2112 through which passes loop 2216 of the base 2200. When the apparatus is in place with loop 2216 passing through the slot 2112, another locking mechanism (such as a padlock 2218) is fitted through loop 2216 to secure the cover 2100 to the base. The loop 2216, the padlock 2218, and the securing member 2110 operate to prevent the cover 2100 from being removed or pried from the door 2300. As depicted in FIG. 2, the cover 2100 can be installed while the door 2300 remains closed and the base 2200 can be installed with the door 2300 open.

The second cover member 2104 extends from the enclosure 2102 and connects the enclosure 2102 to a first joint member 2106. The second cover member 2104 lays flat on or just over a second base member 2204 of the base 2200. As depicted in FIG. 2, the second cover member 2104 and the second base member 2204 may have substantially similar profiles. In alternative embodiments, the second cover member 2104 and the second base member 2204 may have different profiles.

The first joint member 2106 is curved around and up with respect to the second cover member 2104. The first joint member 2106 comprises a tab that fits through the slot 2208 of the second joint member 2206 of the base 2200. The first joint member 2106 and the second joint member 2206 combine to form a releasable joint. The releasable joint can align the cover 2100 with respect to the base 2200. Optional embodiments may have the tab of first joint member 2106 be wide enough such that when it is mated within the slot 2208, the releasable joint acts as a hinge that aligns the cover 2100 to the base 2200, supports the weight of the cover 2100, and allows for angular movement of the cover 2100 with respect to the base 2200. While depicted with a curved slot and tab configuration forming a hinge, the releasable joint can be any suitable shape or type of joint. As an example, the releasable joint could be formed from a hasp and loop with the cover having a hasp or slot that fits onto a loop of the base.

The base 2200 includes a first base member 2202, a second base member 2204, and a third base member 2214. The base 2200 connects the cover 2100 to the door 2300 and sits between the door 2300 and at least one of the door mechanisms protected by the enclosure 2102. As depicted in FIG. 2, the base 2200 sits between the door 2300 and the doorknob 2308. Additional embodiments may also have a gasket, a sheet of plastic, or the like to protect the face 2302 of the door 2300 from a surface of the base.

The first base member 2202 includes a first hole 2210 and one or more second holes 2212. The first base member 2202 has a profile that is similar to at least part of the footprint 2124 of the enclosure 2102.

The first hole 2210 allows an operating mechanism within a door mechanism to pass through the base 2200 and into the door 2300. As depicted in FIG. 2, the operating mechanism of the doorknob 2308 passes through the first hole 2210 so that the latch 2310 may be operated by the doorknob 2308.

The second holes 2212 allow the fasteners of the door mechanism to pass through the base 2200 and into the door 2300. As depicted in FIG. 2, one or more screws 2316 pass through the door 2300, through the second holes 2212, and into the doorknob 2308. As such, the fasteners 2316 of the door mechanism are used to secure the base 2200 to the door 2300 and the fasteners 2316 are also used to secure the doorknob 2308 that is protected by the cover 2100 to the door 2300. While depicted as circular, any shape or profile of the second holes may be used.

The second base member 2204 extends from the first base member 2202 and connects the base 2200 to a second joint member 2206. The second base member 2204 lays flat on the face 2302 of the door 2300. As depicted in FIG. 2, the second base member 2204 and the second cover member 2104 may have substantially similar profiles. In alternative embodiments, the second base member 2204 and the second cover member 2104 may have different profiles.

The second joint member 2206 is curved around and up with respect to the second cover member 2204. The second joint member 2206 comprises a slot 2208 through which fits the tab of the first joint member 2106 of the cover 2100. The second joint member 2206 and the first joint member 2106 combine to form a releasable joint, as discussed above.

The third base member 2214 extends from the first base member 2202 and includes a loop 2216. The profile of the third base member 2214 is substantially similar to the footprint of the first cover member 2108, this helps to properly align the cover 2100 with the base 2200. When the cover 2100 is properly attached to the base 2200, the loop 2216 and the slot 2112 operate to align the cover 2100 with the base 2200, support the weight of the cover 2100 on the base 2200, and to allow for angular movement of the cover 2100 with respect to the base 2200. As described above, the padlock 2218 is used to secure the cover 2100 to the base 2200.

Figure 3:
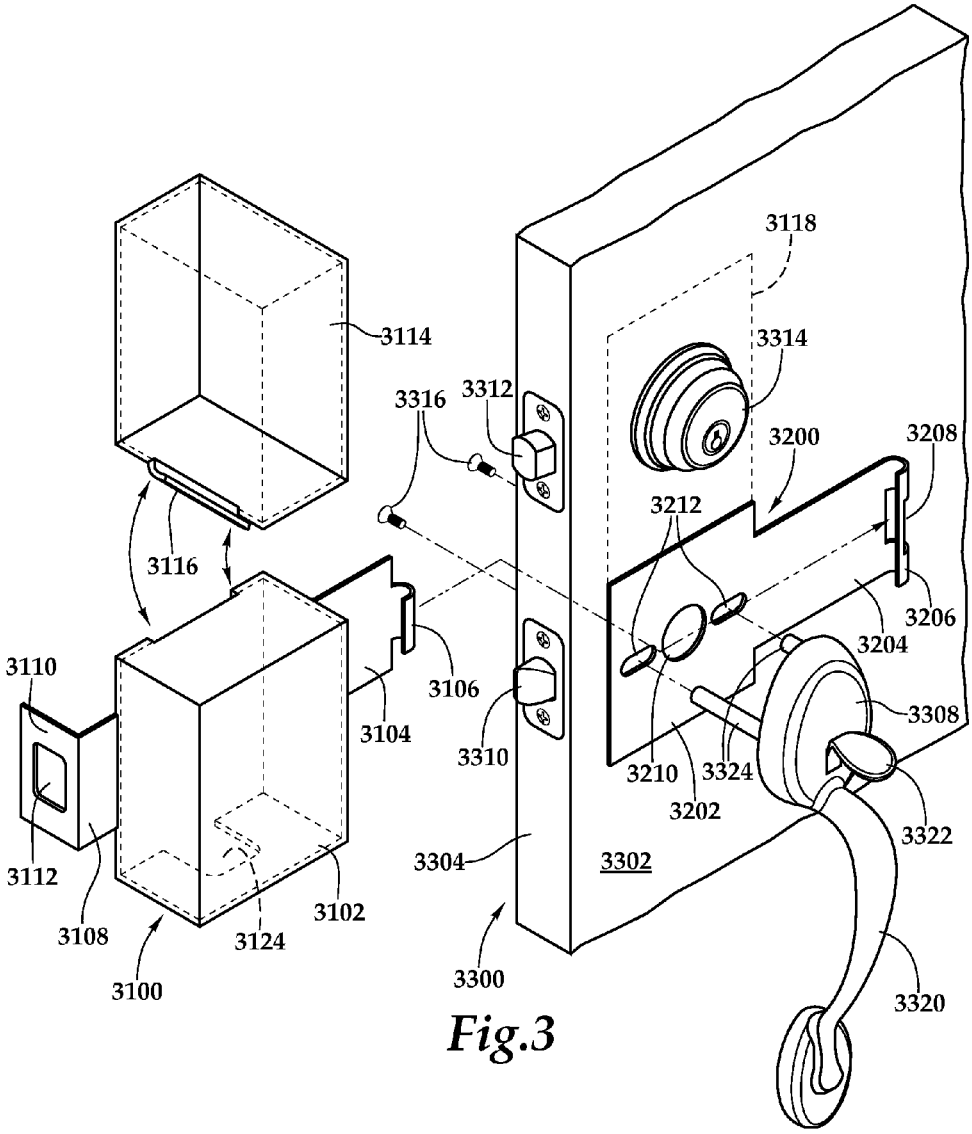
FIG. 3 is a graphical projection of an embodiment that accords with the disclosure.

FIG. 3 is a graphical projection of an embodiment in accordance with the disclosure. FIG. 3 depicts a cover 3100, a base 3200, and a door 3300 that has a deadbolt 3314 and a handleset 3308. In this embodiment, the base 3200 and the cover 3100 cover, protect, and secure the handleset 3308 with a first enclosure 3102, and optionally cover, protect, and secure the deadbolt 3314 with a second enclosure 3114. The deadbolt 3314 operates a bolt 3312, and a lever 3322 of the handleset 3308 operates a latch 3310. The second enclosure 3102 is shown from a bottom perspective, with the rest of FIG. 3 being shown from a top perspective.

The cover 3100 includes a first enclosure 3102, a second enclosure 3114, a first cover member 3108, and a second cover member 3104. When placed over the deadbolt 3314, the cover 3100 and the enclosure 3102 prevent any tampering or picking and greatly inhibits any prying, jimmying, or damaging of the handleset 3308. The enclosure 3102 prevents any access to the lever 3322 of the handleset 3308 that is secured to the door 3300. The enclosure 3102 may have a substantially similar footprint or profile to that of a first base member 3202 of the base 3200. As depicted in FIG. 1, the enclosure 3102 is in the shape of a cube-like structure or cuboid, but maybe in any suitable shape, as desired. The enclosure 3102 prevents any contact from being made with the door mechanism within. The first enclosure 3102 also includes a slot 3124 for handle 3320 of the handleset 3308.

The optional second enclosure 3114 includes a flange 3116. The second enclosure prevents any access to the deadbolt 3314 that is secured to the door 3300. The footprint of the second enclosure 3114 is shown as the dotted-line profile 3118 on the face 3302 of the door 3300. The optional second enclosure 3114 may sit on the first face 3302 of the door 3300, or the first member 3202 of the base 3200 may be extended to include the profile 3118 and match the footprint of the second enclosure 3114. This extension (not shown) may include a first hole for a key mechanism of the deadbolt 3314 and one or more second holes for fastening mechanisms, such as screws or threaded bolts, holding deadbolt 3314 to the door 3300. Alternatively, the extension of the first base member 3202 may fit around or have a hole large enough for the deadbolt 3314 so that installation of the base would not require removing and reinstalling the deadbolt 3314. The side of the second enclosure 3114 that mates with the side of the first enclosure 3102 and the flange 3116 operate to ensure that the second enclosure 3114 is stable and secure on the door 3300 when the cover 3100 is properly secured to the base 3200.

The flange 3116 fits underneath a side of the first enclosure 3102. When the cover 3100 is properly secured to and engaged with the base 3200 and the second enclosure 3114 has properly mated with the first enclosure 3102, then the first enclosure 3102 and the flange 3116 operate to secure of the second enclosure 3114 over and around the deadbolt 3314. As depicted, a side of the first enclosure 3102 is altered to allow for the flange 3116 to properly mate with and fit to the first enclosure 3102. Alternatively, the profile of the base 3200 may be altered (not shown) to allow for the flange 3116 to fit inside of the first enclosure 3102.

The first cover member 3108 extends from the enclosure 3102 and connects the enclosure 3102 to a first securing member 3110, which also includes a slot 3112. As depicted in FIG. 3, the first cover member 3108 allows the cover 3100 to fit onto two orthogonal faces (3302 and 3304) of the door 3300. As depicted in FIG. 3, the first cover member 3108 may lay substantially flat on or just over the door 3300, but alternative embodiments may have an analogous member of the base 3200 upon or over which the first cover member 3108 lays. Alternative embodiments may have at least one gasket (not shown) between any of the base 3200, the cover 3100, and the door 3300 made out of any suitable material including rubber, plastic, any combination thereof, and the like. Such a gasket would provide increased protection to the surface and finish of the door 3300 from the base 3200 and the cover 3100.

The first securing member 3110 includes a slot 3112 through which passes bolt 3312 of the deadbolt 3314. As depicted in the FIG. 3, the first securing member 3110 includes a 90 degree bend to wrap around a first face 3302 and a second face 3304 of the door 3300. When the apparatus is in place and the bolt 3312 of the deadbolt 3314 is engaged and passes through the slot 3112, the bolt 3312 and the securing member 3110 operate to prevent the cover 3100 from being removed or pried from the door 3300.

The second cover member 3104 extends from the enclosure 3102 and connects the enclosure 3102 to a first joint member 3106. The second cover member 3104 lays flat on or just over a second base member 3204 of the base 3200. As depicted in FIG. 3, the second cover member 3104 and the second base member 3204 may have substantially similar profiles. In alternative embodiments, the second cover member 3104 and the second base member 3204 may have different profiles.

The first joint member 3106 is curved around and up with respect to the second cover member 3104. The first joint member 3106 comprises a tab that fits through the slot 3208 of the second joint member 3206 of the base 3200. The first joint member 3106 and the second joint member 3206 combine to form a releasable joint. The releasable joint can align the cover 3100 with respect to the base 3200. Optional embodiments may have the tab of first joint member 3106 be wide enough such that when it is mated within the slot 3208, the releasable joint acts as a hinge that aligns the cover 3100 to the base 3200, supports the weight of the cover 3100, and allows for angular movement of the cover 3100 with respect to the base 3200. While depicted with a curved slot and tab configuration forming a hinge, the releasable joint can be any suitable shape or type of joint. As an example, the releasable joint could be formed from a hasp and loop with the cover having a hasp or slot that fits onto a loop of the base.

The base 3200 includes a first base member 3202 and a second base member 3204. The base 3200 connects the cover 3100 to the door 3300 and sits between the door 3300 and at least one of the door mechanisms protected by the enclosure 3102.

The first base member 3202 includes a first hole 3210 and one or more second holes 3212. The first base member 3202 has a profile that is similar to the footprint of the enclosure 3102.

The first hole 3210 allows an operating mechanism within a door mechanism to pass through the base 3200 and into the door 3300. As depicted in FIG. 3, the operating mechanism of the handleset 3308 passes through the first hole 3210 into the door 3300 so that the latch 3310 may be operated by the lever 3322 of the handleset 3308.

The second holes 3212 allow the fastening mechanisms of the door mechanism to pass through the base 3200 and into the door 3300. As depicted in FIG. 3, one or more screw posts 3324 are connected to the handleset 3308, pass through the second holes 3212, pass into the door 3300, and are secured by screws 3316. As such, the fastening mechanisms 3324 of the door mechanism are used to secure the base 3200 to the door 3300 and are also used to secure the handleset 3308 that is protected by the cover 3100 to the door 3300. Also as depicted in FIG. 3, the second holes 3212 need not be circular and may be shaped in order to accommodate different spacings between and sizings of the fastening mechanisms of door mechanisms from different manufactures. In other words, different manufacturers may have their fastening mechanisms being spaced at different distances apart and use different sizes of parts, so that for the base to accommodate door mechanisms from different manufacturers, the second holes 3212 may be shaped so was to allow for these differences in spacing and sizing. Any shape or profile of the second holes may be used.

The second base member 3204 extends from the first base member 3202 and connects the base 3200 to a second joint member 3206. The second base member 3204 lays flat on the face 3302 of the door 3300. As depicted in FIG. 3, the second base member 3204 and the second cover member 3104 may have substantially similar profiles. In alternative embodiments, the second base member 3204 and the second cover member 3104 may have different profiles.

The second joint member 3206 is curved around and up with respect to the second cover member 3204. The second joint member 3206 comprises a slot 3208 through which fits the tab of the first joint member 3106 of the cover 3100. The second joint member 3206 and the first joint member 3106 combine to form a releasable joint, as discussed above.

Figure 4:
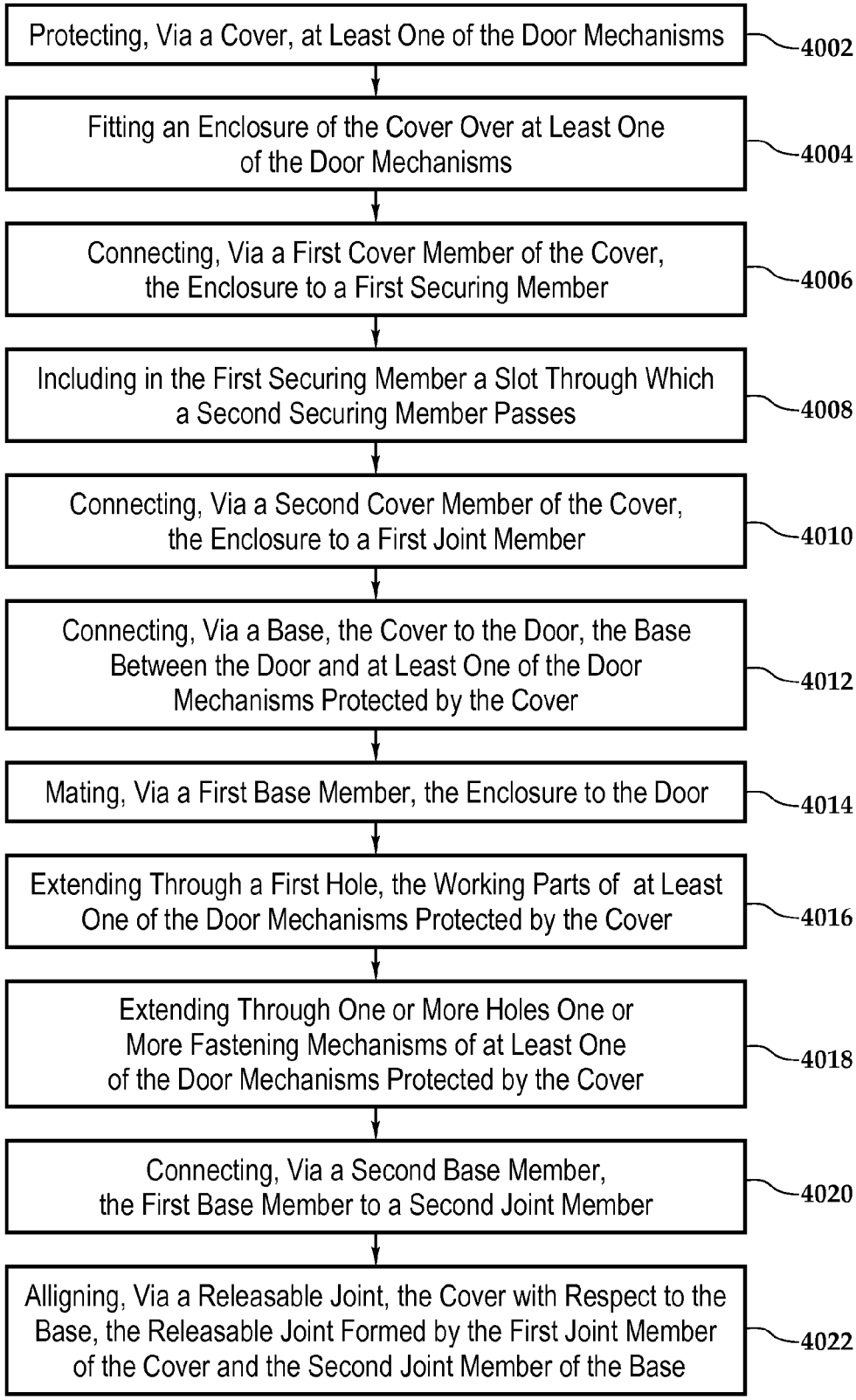
FIG. 4 is a flowchart illustrating a method that accords with the disclosure.

FIG. 4 is a flowchart illustrating a method that accords with the disclosure. The method involves using an apparatus with a base and a cover to secure a door from unauthorized access or tampering.

At 4002, the cover protects at least one of the door mechanisms. Door mechanisms include handlesets, doorknobs, deadbolts, springbolts, and the like. Embodiments may have a cover designed to protect a single door mechanism, multiple door mechanisms, or a variable number of door mechanisms. Alternative embodiments of the apparatus may have the enclosure comprising a slot through which passes a non-moving portion of the door mechanism, such as a door handle of a handleset. In such embodiments, the slot allows for a portion of the door mechanism to be outside of the enclosure, in other words, not all of the door mechanism needs be contained by the enclosure.

At 4004, an enclosure of the cover is fitted over the at least one of the door mechanisms. The enclosure may also include an optional door that allows, via the optional door and a locking mechanism of the enclosure, access to the at least one of the door mechanisms protected by the cover to provide authorized access to the door mechanisms protected by the cover.

At 4006, a first cover member of the cover connects the enclosure to a first securing member. The first cover member extends from the enclosure and optionally wraps around two orthogonal faces of the door via a bend in the cover.

At 4008, the first securing member is includes a slot through which a second securing member passes. As an example, the second securing member may be the bolt of a deadbolt so that the slot and the deadbolt operate to prevent prying the apparatus from the door. Alternatively, the second securing member may be a loop on the base through which a padlock may be fitted.

At 4010, a second cover member of the cover connects the enclosure to a first joint member. The first joint member and a second joint member combine to form a releasable joint. The releasable joint can align the cover with respect to the base. Additional embodiments may have that the releasable joint, created by the combination of the first joint member and the second joint member, acts as a hinge that aligns the cover to the base, can support the weight of the cover, and allows for angular movement of the cover with respect to the base. In such an embodiment, the releasable joint allows the base to support the cover prior to engaging the first securing member with the second securing member. The releasable joint can be any suitable shape or type of joint. As an example, the releasable joint could be formed from a hasp and loop with the cover having a hasp or slot that fits onto a loop of the base.

At 4012, the base connects the cover to the door. The base is between the door and at least one of the door mechanisms protected by the cover. Alternative embodiments may have at least one gasket (not shown) between any combination of the base, the cover, and the door made out of any suitable material including rubber, plastic, any combination thereof, and the like. Such a gasket would provide increased protection to the surface and finish of the door from the base and the cover.

At 4014, a first base member mates the enclosure to the door. The enclosure and the first base member may have substantially similar profiles.

At 4016, working parts of the at least one of the door mechanisms protected by the cover are extended through a first hole of the base. As an example, the key mechanism of a deadbolt lock may extend through the first hole to allow the key mechanism to operate the bolt of the deadbolt.

At 4018, one or more fasteners of the at least one of the door mechanisms protected by the cover are extended through one or more second holes. The fasteners may be of any suitable type, such as one or more screws or bolts. The fasteners are used to secure the base to the door and are also used to secure the door mechanism that is protected by the cover to the door. The fasteners, or fastening mechanisms, are the ones used to secure the door mechanism and can be the ones supplied by the manufacturer of the door mechanism. As such, installing the base and cover to a door would utilize the existing fastening mechanisms, screws, threaded bolts, and the like, of the door mechanism previously installed on the door.

At 4020, a second base member connects the first base member to a second joint member. The second base member and the second cover member may have substantially similar profiles. In alternative embodiments, the second base member and the second cover member may have different profiles.

At 4022, a releasable joint aligns the cover with respect to the base. The releasable joint is formed by the first joint member of the cover and the second joint member of the base. As an example, a tab of a curved portion of the second base member may be fitted into a slot of a curved portion of the second cover member to form the releasable joint as a hinge.

This written description uses examples to disclose the invention and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

What is claimed is:

1. An apparatus for securing a door having one or more door mechanisms, the apparatus comprising:

a cover protecting at least one of the door mechanisms, the cover comprising:

an enclosure fitting over the at least one of the door mechanisms;

a first cover member connecting the enclosure to a first securing member;

the first securing member comprising a slot through which a second securing member passes;

a second cover member connecting the enclosure to a first joint member;

a base connecting the cover to the door and sitting between the door and at least one of the door mechanisms protected by the cover, the base comprising:

a first base member mating the enclosure to the door, the first base member comprising:

a first hole extending through which are the working parts of the at least one of the door mechanisms protected by the cover;

one or more second holes extending through which are one or more fastening mechanisms of the at least one of the door mechanisms protected by the cover;

a second base member connecting the first base member to a second joint member;

a releasable joint aligning the cover with respect to the base, the releasable joint formed by the first joint member of the cover and the second joint member of the base;

wherein the one or more door mechanisms comprises one of a deadbolt and a doorknob;

wherein the second securing member is a bolt of the deadbolt.

2. The apparatus of claim 1, wherein the cover comprises a bend allowing the cover to fit onto two orthogonal faces of the door.

3. The apparatus of claim 1, wherein the second securing member is a loop on the base through which a padlock may be fitted.

4. The apparatus of claim 1, wherein the releasable joint is a hinge, the second base member comprises a first curved portion comprising a slot, the second cover member comprises a second curved portion comprising a tab, and the hinge is formed by placing the tab of the second curved portion into the slot of the first curved portion.

5. The apparatus of claim 1, wherein the releasable joint supports the cover with respect to the base prior to engaging the first securing member with the second securing member.

6. The apparatus of claim 1, wherein the enclosure comprises a slot through which passes a non-moving portion of the door mechanism.

7. The apparatus of claim 1, wherein the enclosure and the first base member have substantially similar profiles.

8. The apparatus of claim 1, wherein the enclosure further comprises a door and a locking mechanism allowing access to the at least one of the door mechanisms protected by the cover.

9. A method for securing a door having one or more door mechanisms, the method comprising:

protecting, via a cover, at least one of the door mechanisms;

fitting an enclosure of the cover over the at least one of the door mechanisms;

connecting, via a first cover member of the cover, the enclosure to a first securing member;

including in the first securing member, a slot through which a second securing member passes;

connecting, via a second cover member of the cover, the enclosure to a first joint member;

connecting, via a base, the cover to the door, the base between the door and at least one of the door mechanisms protected by the cover;

mating, via a first base member, the enclosure to the door;

extending through a first hole, the working parts of the at least one of the door mechanisms protected by the cover;

extending through one or more second holes, one or more fastening mechanisms of the at least one of the door mechanisms protected by the cover;

connecting, via a second base member, the first base member to a second joint member; and aligning, via a releasable joint, the cover with respect to the base, the releasable joint formed by the first joint member of the cover and the second joint member of the base;

wherein the one or more door mechanisms comprises one of a deadbolt and a doorknob;

wherein the second securing member is a bolt of the deadbolt.

10. The method of claim 1, further comprising allowing, via a bend in the cover, the cover to fit onto two orthogonal faces of the door.

11. The method of claim 9, wherein the second securing member is a loop on the base through which a padlock may be fitted.

12. The method of claim 9, further comprising placing a tab of a second curved portion of the second cover member into a slot of a first curved portion of the second base member to form the releasable joint as a hinge.

13. The method of claim 9, supporting, via the releasable joint, the cover with respect to the base prior to engaging the first securing member with the second securing member.

14. The method of claim 9, wherein the enclosure comprises a slot through which passes a non-moving portion of the door mechanism.

15. The method of claim 9, wherein the enclosure and the first base member have substantially similar profiles.

16. The method of claim 9, allowing, via a door and a locking mechanism of the enclosure, access to the at least one of the door mechanisms protected by the cover.

* * * * *